US008608153B2

(12) United States Patent
Ro et al.

(10) Patent No.: US 8,608,153 B2
(45) Date of Patent: Dec. 17, 2013

(54) PRINTING MEDIA LOADING APPARATUS USABLE WITH IMAGE FORMING APPARATUS

(75) Inventors: Ju-sang Ro, Seoul (KR); Ji-hoon Woo, Hwaseong-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 0 days.

(21) Appl. No.: 13/551,837

(22) Filed: Jul. 18, 2012

(65) Prior Publication Data

US 2013/0161893 A1 Jun. 27, 2013

(30) Foreign Application Priority Data

Dec. 26, 2011 (KR) ..... 10-2011-0142818

(51) Int. Cl.
*B65H 3/44* (2006.01)

(52) U.S. Cl.
USPC ..... 271/9.11; 271/9.13

(58) Field of Classification Search
USPC ..... 271/9.01, 9.09, 9.11, 9.13; 399/391
See application file for complete search history.

(56) References Cited

U.S. PATENT DOCUMENTS

2004/0061283 A1* 4/2004 Hyun ..... 271/265.01

* cited by examiner

*Primary Examiner* — Michael McCullough
(74) *Attorney, Agent, or Firm* — Stanzione & Kim, LLP

(57) ABSTRACT

A printing media loading apparatus includes a first printing media loading unit detachably disposed in an image forming apparatus; a second printing media loading unit disposed above the first printing media loading unit; a first lever assembly rotatably disposed in the first printing media loading unit; a second lever assembly disposed in the second printing media loading unit to selectively rotate the first lever assembly; and a detecting sensor disposed in the image forming apparatus to detect action of the first lever assembly, wherein, when at least one printing medium is loaded on the second printing media loading unit and there is no printing medium loaded on the first printing media loading unit, the second lever assembly is rotated and the first lever assembly is rotated by rotation of the second lever assembly to activate the detecting sensor.

21 Claims, 14 Drawing Sheets

PRINTING MEDIA LOADING APPARATUS USABLE WITH IMAGE FORMING APPARATUS

CROSS-REFERENCE TO RELATED APPLICATIONS

This application claims the benefit of priority under 35 U.S.C. §119(a) from Korean Patent Application No. 2011-142818 filed Dec. 26, 2011 in the Korean Intellectual Property Office, the disclosure of which is incorporated herein by reference in its entirety.

BACKGROUND OF THE INVENTION

1. Field of the Invention

The present general inventive concept relates to an image forming apparatus. More particularly, the present general inventive concept relates to a printing media loading apparatus usable with an image forming apparatus.

2. Description of the Related Art

Generally, an image forming apparatus includes a printing media loading apparatus that stores a certain amount of printing media and allows a pickup unit to pick up a printing medium. The printing media loading apparatus may include a main printing media loading means, a printing medium feeding cassette, an auxiliary printing media loading means, and a multi-purpose tray that can load a sheet or less than 50 sheets of printing media.

In order to allow a control portion of the image forming apparatus to know whether at least one printing medium is loaded on the printing medium feeding cassette and the multi-purpose tray, a paper sensor that can detect the presence of printing medium is disposed in each of the printing medium feeding cassette and the multi-purpose tray.

By using the paper sensor, the control portion can detect whether there is a printing medium on the printing medium feeding cassette and the multi-purpose tray, indicate the result to a user, prevent trouble due to malfunction, and perform a certain printing on a printing medium.

However, in a conventional printing media loading apparatus usable with an image forming apparatus, material cost is increased since sensors are disposed in both the printing medium feeding cassette and the multi-purpose tray to detect loading of the printing media. Also, since space is needed for disposing the two sensors, it is difficult to miniaturize the image forming apparatus.

SUMMARY OF THE INVENTION

The present general inventive concept has been developed in order to provide a printing media loading apparatus usable with an image forming apparatus capable of detecting whether at least one printing medium is loaded on any of two printing media loading units by using one sensor.

Additional features and utilities of the present general inventive concept will be set forth in part in the description which follows and, in part, will be obvious from the description, or may be learned by practice of the general inventive concept.

Features and utilities of the present general inventive concept can be achieved by providing a printing media loading apparatus usable with an image forming apparatus which may include a first printing media loading unit detachably disposed in the image forming apparatus, a second printing media loading unit disposed above the first printing media loading unit when the first printing media loading unit is mounted in the image forming apparatus, a first lever assembly rotatably disposed in the first printing media loading unit, a second lever assembly disposed in the second printing media loading unit to selectively rotate the first lever assembly, and a detecting sensor disposed in the image forming apparatus to detect action of the first lever assembly, wherein when at least one printing medium is loaded on the second printing media loading unit in a state that there is no printing medium loaded on the first printing media loading unit, the second lever assembly is rotated and the first lever assembly is rotated by rotation of the second lever assembly to activate the detecting sensor.

When at least one printing medium is loaded on the first printing media loading unit, the first lever assembly may be operated to activate the detecting sensor, and when the at least one printing medium is loaded on the second printing media loading unit in a state that the at least one printing medium is loaded on the first printing media loading unit, the second lever assembly may not rotate the first lever assembly.

The first lever assembly may include a sensor lever that is rotatably disposed in the first printing media loading unit and activates the detecting sensor, a first operating lever that is disposed to rotate with respect to the sensor lever and rotated by either the second lever assembly or the printing medium loaded on the first printing media loading unit, and a first elastic member disposed between the sensor lever and the first operating lever.

The sensor lever may include a sensor lever shaft rotatably disposed in the first printing media loading unit, a sensor arm extending away from the sensor lever shaft, the sensor arm may extend in a direction vertical from the sensor lever shaft, and a weight portion disposed on a side surface of the sensor arm, wherein the first operating lever comprises a shaft receiving portion, in which the sensor lever shaft is inserted, and a first operating arm extending away from the shaft receiving portion. The first operating arm may extend in a direction vertical from the shaft receiving portion.

The sensor lever may include a protrusion formed on the sensor lever shaft, and the first operating lever may include an insert groove formed on the shaft receiving portion in an axial direction of the shaft receiving portion, the insert groove formed to receive the protrusion, and a fixing groove formed on the shaft receiving portion in a direction perpendicular to the insert groove, the fixing groove being arranged to fix the protrusion.

When the protrusion is positioned in the fixing groove, the first operating lever and the sensor lever may not be separated from each other.

The second lever assembly may include a pressure lever that is rotatably disposed in the second printing media loading unit and selectively presses the first operating lever of the first lever assembly, a second operating lever that is disposed to be able to rotate with respect to the pressure lever and rotated by the printing medium loaded on the second printing media loading unit, a second elastic member disposed between the pressure lever and the second operating lever, and a third elastic member elastically supporting the pressure lever so that the pressure lever is in a position that is close to the second printing media loading unit.

The pressure lever may include a pressure lever shaft rotatably disposed in the second printing media loading unit, and a pressure arm extending away from the pressure lever shaft. The pressure arm may extend in a direction vertical from the pressure lever shaft. The second operating lever may include a shaft receiving portion, in which the pressure lever shaft is inserted, and a second operating arm extending away from the shaft receiving portion. The second operation arm may extend in a direction vertical from the shaft receiving portion.

The pressure lever may include at least one protrusion formed on the pressure lever shaft, and the second operating lever may include an insert groove formed on the shaft receiving portion in an axial direction of the shaft receiving portion, the insert groove being formed to receive the protrusion, and a fixing groove being formed on the shaft receiving portion in a direction perpendicular to the insert groove, the fixing groove being arranged to fix the protrusion.

When the protrusion is positioned in the fixing groove, the second operating lever may not be separated from the pressure lever.

The second printing media loading unit may be disposed above and formed integrally with the first printing media loading unit.

The first printing media loading unit may include a printing medium feeding cassette, and the second printing media loading unit may include a multi-purpose tray disposed above the printing medium feeding cassette.

The printing medium feeding cassette may include a pressure plate, the first lever assembly may be disposed below the pressure plate and on a bottom surface of the printing medium feeding cassette, and the second lever assembly may be disposed on a bottom surface of the second printing media loading unit.

The printing medium feeding cassette may include a sensing hole that is formed on a front surface of the printing medium feeding cassette and limits rotation of the sensor lever, the sensing hole through which the sensor lever of the first lever assembly projects, and a first operating hole formed on the pressure plate, the first operating hole through which a portion of the first operating lever of the first lever assembly projects above the pressure plate.

The second printing media loading unit may include a second operating hole through which a portion of the second operating lever of the second lever assembly projects.

Features and utilities of the present general inventive concept provide an image forming apparatus that includes a printing media loading apparatus supplying a printing medium and having at least one of features described above; an image forming unit forming an image on the printing medium supplied from the printing media loading apparatus, and a control portion configured to control the printing media loading apparatus and the image forming unit to perform a printing.

When the printing medium is loaded on at least one between the first printing media loading unit and the second printing media loading unit, the control portion may determine that the printing medium is loaded.

The foregoing and/or other aspects and utilities of the present general inventive concept may also be achieved by providing an image forming apparatus comprising a first printing media loading unit, a first lever arranged to move according to a presence of a first printing medium on the first printing media loading unit, a second printing media loading unit, a second lever arranged to move according to a presence of a second printing medium on the second printing media loading unit and the first printing media loading unit being free from presence of the first printing medium thereon, and, upon movement, the second lever causing movement of the first lever, and a single detecting sensor to detect the movement of the first lever.

The image forming apparatus being free from a second detecting sensor to detect a movement of the second lever when at least one second printing medium is present on the second printing media loading unit regardless of whether the first printing medium is present on the first printing media loading unit.

The first lever further comprises a first operating lever, and a sensor lever, the first operating lever being coupled with the sensor lever and, when at least one first printing medium is loaded on the first printing media loading unit, the first lever being moved by the first printing medium which causes movement of the first operating lever and the sensor lever to activate the single detecting sensor.

The first operating lever and the sensor lever may be formed of a synthetic resin containing glass.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
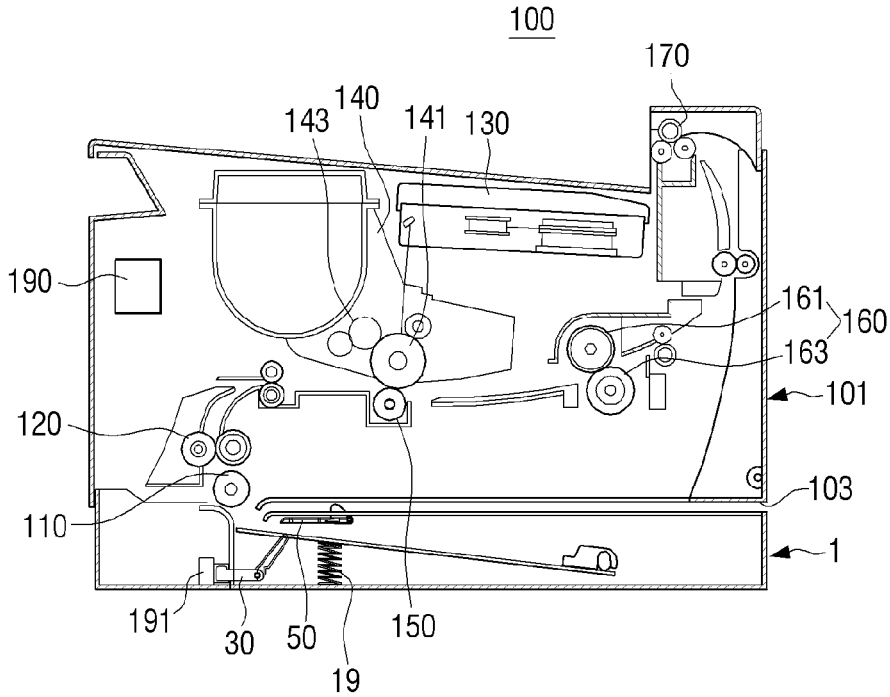
FIG. 1 is a sectional view schematically illustrating an image forming apparatus including a printing media loading apparatus according to an exemplary embodiment of the present inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

Figure 2:
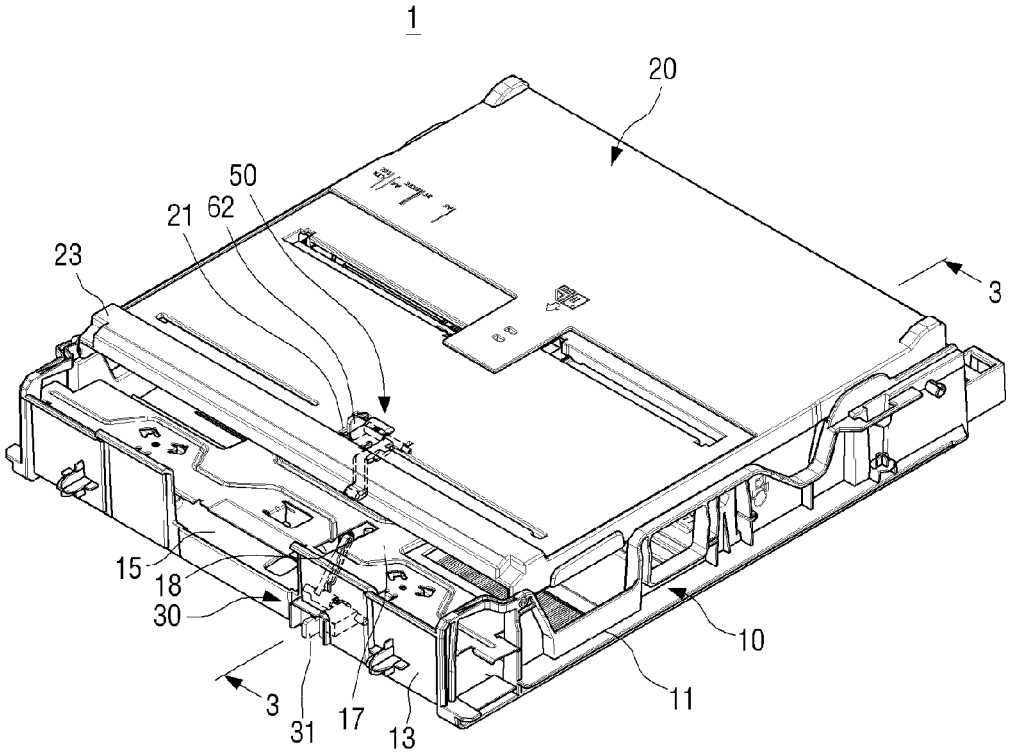
FIG. 2 is a perspective view schematically illustrating a printing media loading apparatus according to an exemplary embodiment of the present inventive concept.
Figure 3:
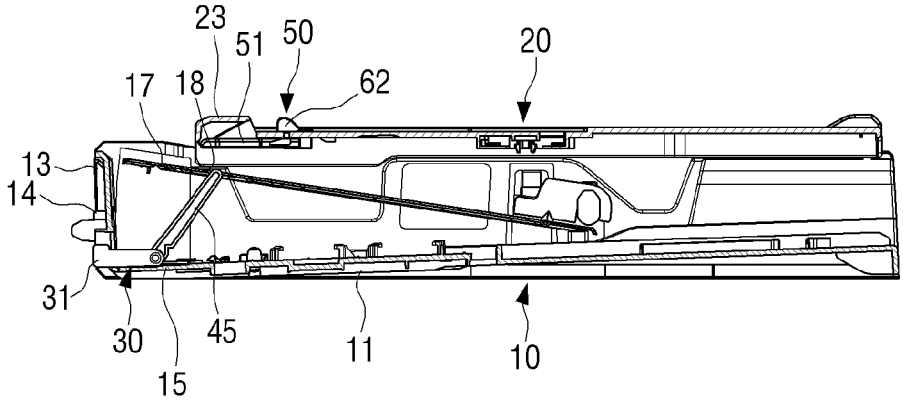
FIG. 3 is a sectional view illustrating the printing media loading apparatus of FIG. 2 taken along a line 3-3 in FIG. 2.

FIG. 1 is a sectional view schematically illustrating an image forming apparatus including a printing media loading apparatus according to an exemplary embodiment of the present disclosure. FIG. 2 is a perspective view schematically illustrating a printing media loading apparatus according to an exemplary embodiment of the present disclosure, and FIG. 3 is a sectional view illustrating the printing media loading apparatus of FIG. 2 taken along a line 3-3 in FIG. 2;

Referring to FIG. 1, an image forming apparatus 100 according to an exemplary embodiment of the present inventive concept includes a case 101, a printing media feeding unit, an image forming unit 140, a transfer roller 150, a fusing unit 160, and a printing media discharging unit 170.

The case 101 defines an outer appearance of the image forming apparatus 100 according to an exemplary embodiment of the present inventive concept, and may support and secure the printing media feeding unit, the image forming unit 140, the transfer roller 150, the fusing unit 160, and the printing media discharging unit 170 inside thereof.

The printing medium feeding unit stores certain sheets of printing media P, and feeds the printing medium P to the image forming unit 140 one by one. The printing medium feeding unit may include a printing media loading apparatus 1 in which certain sheets of printing media P are loaded and a pickup roller 110 that picks up the printing media P loaded in the printing media loading apparatus 1 one by one.

The pickup roller 110 is disposed in front of the printing media loading apparatus 1 and picks up the printing media P loaded in the printing media loading apparatus 1 one by one to feed the picked up printing medium P to a carrying roller 120.

The printing media loading apparatus 1 may include a first printing media loading unit 10 and a second printing media loading unit 20 located above the first printing media loading unit 10.

The first printing media loading unit 10 is detachably disposed in a printing media loading space 103 provided in a lower portion of the case 101 of the image forming apparatus 100. Accordingly, the first printing media loading unit 10 may be formed as a printing medium feeding cassette. The second printing media loading unit 20 is disposed above the first printing media loading unit 10 when the first printing media loading unit 10 is mounted in the image forming apparatus 100. Accordingly, the second printing media loading unit 20 may be disposed in the case 101 of the image forming apparatus 100 or formed integrally with the first printing media loading unit 10.

Hereinafter, the second printing media loading unit 20 that is formed integrally with the first printing media loading unit 10 will be explained.

FIGS. 2 and 3 are a perspective view and a sectional view illustrating the printing media loading apparatus 1 usable with an image forming apparatus 100 according to an exemplary embodiment of the present inventive concept.

Referring to FIGS. 2 and 3, the printing media loading apparatus 1 according to an exemplary embodiment of the present inventive concept may include a first printing media loading unit 10, a second printing media loading unit 20, a first lever assembly 30, a second lever assembly 50, and a detecting sensor 191.

The first printing media loading unit 10 is detachably mounted into the case 101 of the image forming apparatus 100 and may be formed in a cassette shape. In other words, the first printing media loading unit 10 may be formed in a printing medium feeding cassette. Accordingly, the first printing media loading unit 10 may include a cassette 11 formed in a substantially rectangular box shape and a pressure plate 17 that is disposed inside the cassette 11 and elastically supports printing media P upwardly. The pressure plate 17 has one end connected to a bottom surface of the cassette 11 by a hinge and can be rotated at a predetermined angle. A first operating hole 18 through which some portion of the first lever assembly 30 projects is formed on the pressure plate 17. A pressure member 19 is disposed beside the first lever assembly 30 and between the pressure plate 17 and the bottom surface 15 of the cassette 11 to upwardly press the pressure plate 17. The pressure member 19 may be an elastic member. A coil spring can be used as the pressure member 19.

The second printing media loading unit 20 is formed integrally with the first printing media loading unit 10 above the first printing media loading unit 10. In other words, the second printing media loading unit 20 is formed in a plate shape covering an upper portion of the cassette 11 of the first printing media loading unit 10. Accordingly, after the first printing media loading unit 10 is mounted into the image forming apparatus 100, the second printing media loading unit 20 is located above the first printing media loading unit 10. A second operating hole 21 through which some portion of the second lever assembly 50 projects is formed on the second printing media loading unit 20. A printing medium guide part 23 may be disposed in front of the second printing media loading unit 20 to guide a printing medium P being loaded on the second printing media loading unit 20 toward the first printing media loading unit 10.

Figure 4:
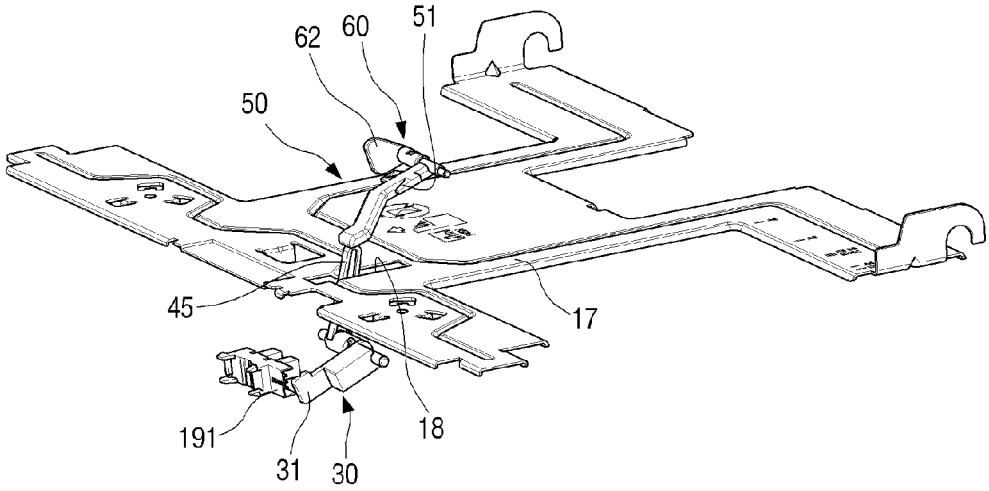
FIG. 4 is a perspective view illustrating the printing media loading apparatus of FIG. 2 of which only a first and a second lever assemblies and a pressure plate are remained and the other parts thereof are removed.
Figure 5:
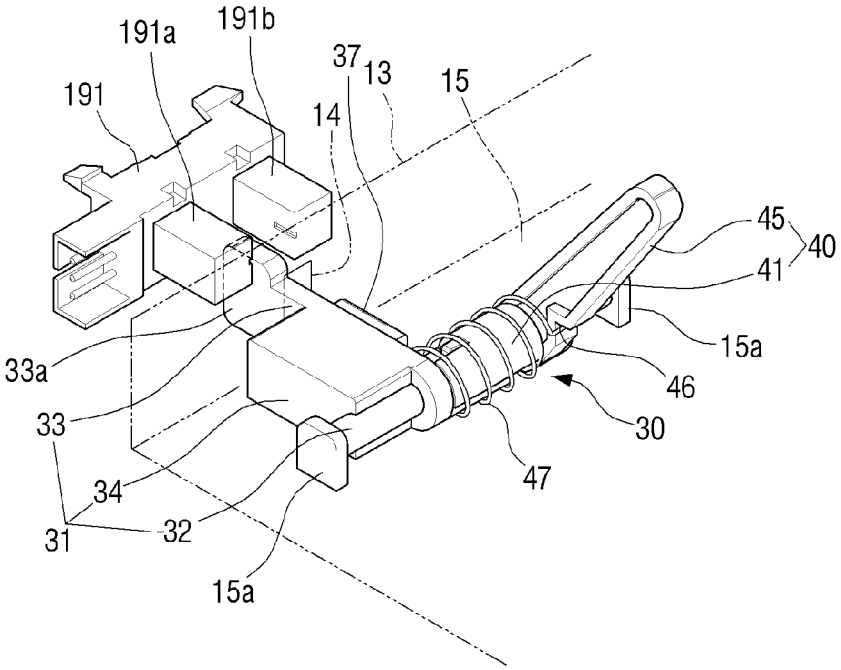
FIG. 5 is a perspective view illustrating a first lever assembly of the printing media loading apparatus of FIG. 2.
Figure 6:
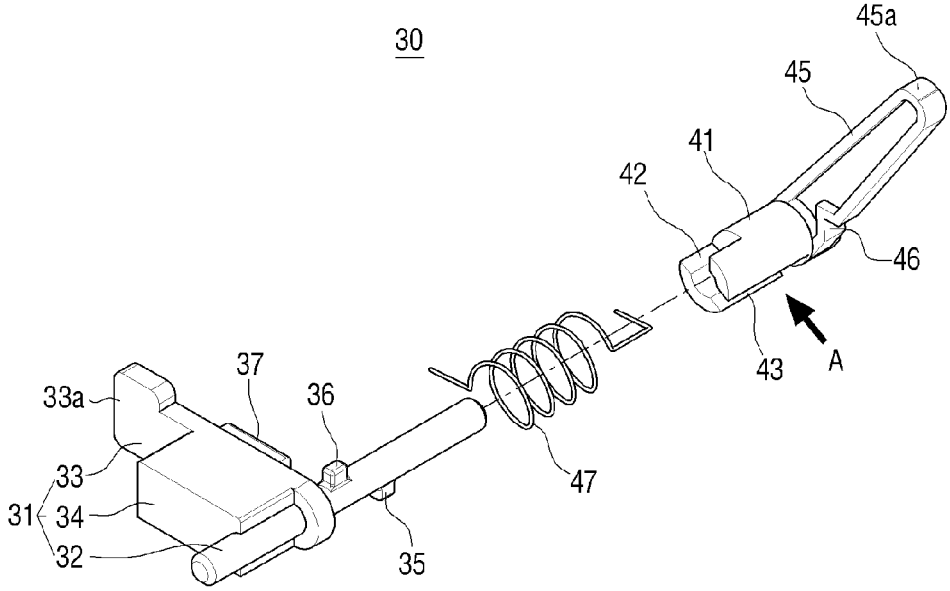
FIG. 6 is an exploded perspective view illustrating the first lever assembly of FIG. 5.
Figure 7:
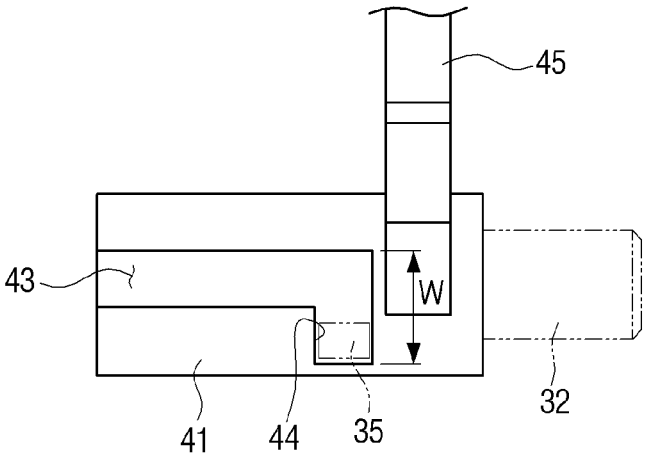
FIG. 7 is a partially plan view illustrating a first operating lever of FIG. 6 viewed in a direction of arrow A in FIG. 6.
Figure 8:
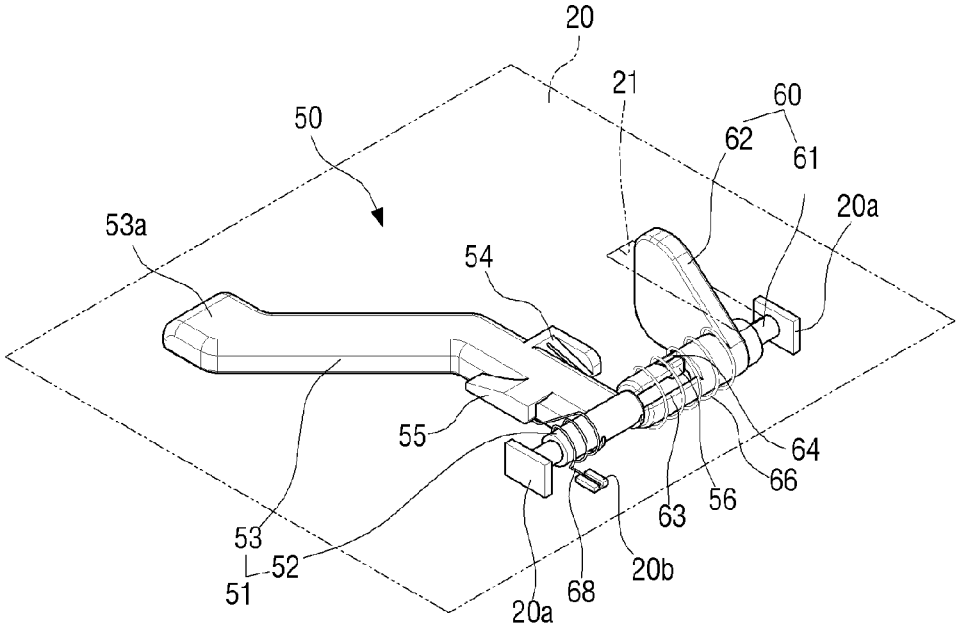
FIG. 8 is a perspective view illustrating a second lever assembly of the printing media loading apparatus of FIG. 2.
Figure 9:
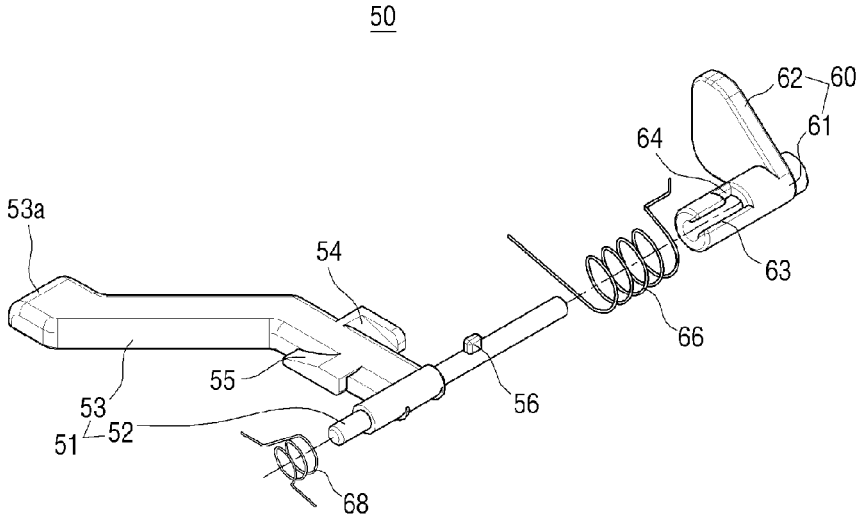
FIG. 9 is an exploded perspective view illustrating the second lever assembly of FIG. 8.

FIG. 4 is a perspective view illustrating the first and second lever assemblies 30 and 50 and the pressure plate 17 of the printing media loading apparatus 1 of FIG. 2. FIG. 5 is a perspective view illustrating the first lever assembly 30 of the printing media loading apparatus 1 of FIG. 2. FIG. 6 is an exploded perspective view illustrating the first lever assembly 30 of FIG. 5. FIG. 7 is a partially plan view illustrating a first operating lever 40 of FIG. 6 viewed in a direction of an arrow A in FIG. 6. FIG. 8 is a perspective view illustrating the second lever assembly 50 of the printing media loading apparatus 1 of FIG. 2. FIG. 9 is an exploded perspective view illustrating the second lever assembly 50 of FIG. 8.

The first lever assembly 30 is formed to activate the detecting sensor 191 when at least printing medium P is loaded on the first printing media loading unit 10. Referring to FIGS. 4, 5, and 6, the first lever assembly 30 is rotatably disposed in the first printing media loading unit 10 and includes a sensor lever 31, a first operating lever 40, and a first elastic member 47.

The sensor lever 31 operates the detecting sensor 191 and is rotatably disposed in the cassette 11 of the first printing media loading unit 10. The sensor lever 31 includes a sensor lever shaft 32 that is rotatably disposed on the bottom surface 15 of the first printing media loading unit 10, a sensor arm 33 extending away from the sensor lever shaft 32, and a weight portion 34 provided on a side surface of the sensor arm 33. The sensor arm 33 may be extended in a perpendicular direction from the sensor lever shaft 32. Opposite ends of the sensor lever shaft 32 are rotatably supported by two shaft supporting members 15*a* projecting from the bottom surface 15 of the cassette 11. At least one protrusion 35 and 36 for connecting with the first operating lever 40 may be formed on the sensor lever shaft 32. A front end portion of the sensor arm 33 is formed to project through a sensing hole 14 formed on a front surface 13 of the cassette 11 and activate the detecting sensor 191 disposed in the image forming apparatus 100. For example, as illustrated in FIG. 5, if a photo sensor is used as the detecting sensor 191, the front end portion of the sensor arm 33 is formed to project through the sensing hole 14 of the front surface of the cassette 11, enter a sensing range between a light emitting portion 191*a* and a light receiving portion 191*b* of the photo sensor 191, and have a plate shape with a size corresponding to the size of the light emitting portion 191*a* of the photo sensor 191 in order to block light emitting from the light emitting portion 191*a* from entering the light receiving portion 191*b*.

The weight portion 34 is formed so that when the sensor lever 31 is coupled with the first operating lever 40, the sensor lever 31 has a different weight than the first operating lever 40. The weight of the sensor lever 31 may be heavier in weight than the first operating lever 40. Accordingly, when no force is applied from the outside to the first operating lever 40, due to the weight portion 34, the front end portion of the sensor arm 33 is positioned in a location where the front end portion of the sensor arm 33 does not activate the detecting sensor 191. In other words, if the detecting sensor 191 is a photo sensor, the sensor arm 33 is positioned outside the sensing area thereof to allow the light emitted from the light emitting portion 191*a* of the photo sensor 191 to be received by the light receiving portion 191*b*. The detecting sensor 191 may selectively allow transmission of light between the light emitting portion 191*a* and the light receiving portion 191*b* depending on the position of the weight portion 34 of the sensor lever 31. The weight portion 34 may be formed separately from the sensor lever 31. However, in the present exemplary embodiment, the weight portion 34 is formed integrally with the sensor arm 33. Also, a fixing projection 37, to which one end of the first elastic member 47 is fixed, is provided on a side surface of the sensor arm 33.

The first operating lever 40 allows the first lever assembly 30 to be rotated by at least one printing medium P being loaded on the first printing media loading unit 10 or the second lever assembly 50. The first operating lever 40 is disposed on the sensor lever shaft 32 of the sensor lever 31 to rotate a predetermined angle based on the sensor lever shaft 32. The first operating lever 40 is configured of a first shaft receiving portion 41 into which the sensor lever shaft 32 is inserted and a first operating arm 45 perpendicularly extending from the first shaft receiving portion 41.

The first shaft receiving portion 41 is formed in a hollow cylindrical shape in which the sensor lever shaft 32 of the sensor lever 31 can be inserted and smoothly rotated, and may have insert grooves 43 and 42 in which protrusions 35 and 36, formed on the sensor lever shaft 32, are inserted. The insert grooves 43 and 42 are deeply formed on the first shaft receiving portion 41 in the axial direction of the first shaft receiving portion 41 so that the protrusions 35 and 36, formed on the sensor lever shaft 32, are respectively inserted into the insert grooves 43 and 42. A fixing groove 44 is formed on a bottom end of the insert groove 43 near the first operating arm 45 and extends in a direction perpendicular to the insert groove 43 to fix the protrusion 35 of the sensor lever shaft 32. Accordingly, after the protrusion 35 of the sensor lever shaft 32 is inserted into the insert groove 43 of the first shaft receiving portion 41 of the first operating lever 40, and then, rotated a predetermined angle, the protrusion 35 is positioned in the fixing groove 44. As a result, the sensor lever 31 and the first operating lever 40 are coupled with, and not separated from, each other. The sensor lever 31 and the first operating lever 40 may be disposed to be movable with respect to each other.

Further, the size of the protrusion 35 and width W of the fixing groove 44 and insert groove 43, as illustrated in FIG. 7, determines an angle by which the first operating lever 40 can rotate with respect to the sensor lever shaft 32. Only one protrusion 35 and one insert groove 43 may be formed. However, in this exemplary embodiment, an auxiliary protrusion 36 and an auxiliary insert groove 42 are additionally formed to allow the first operating arm 45 to be smoothly rotated with respect to the sensor lever shaft 32. The first operating arm 45 may be disposed to be rotated without any friction with the sensor lever shaft 32. However, the auxiliary insert groove 42 has no fixing groove.

The first operating arm 45 extends away from the first shaft receiving portion 41 and has a length that is sufficient for a front end of the first operating arm 45 to project through the first operating hole 18 formed on the pressure plate 17 of the first printing media loading unit 10. The first operating arm 45 may extend in a vertical direction with respect to the first shaft receiving portion 41. Also, the first operating arm 45 is formed so that when at least one printing medium P is loaded on the pressure plate 17 of the first printing media loading unit 10, the front end 45*a* of the first operating arm 45 is pressed down by the printing medium P, and rotated a predetermined angle so as to maintain the same level as that of the top surface of the pressure plate 17. The first operating arm 45 is provided with a hooking groove 46 to which one end of the first elastic member 47 is hooked. The first operating lever 40 and the sensor lever 31 may be formed of a material, for example a synthetic resin containing glass, in order to minimize deformation.

The first elastic member 47 is disposed between the sensor lever 31 and the first operating lever 40. In other words, the first elastic member 47 is inserted around an outer circumferential surface of the first shaft receiving portion 41 so as to allow the first operating arm 45 to be rotated a certain angle with respect to the sensor lever shaft 32. The first elastic member 47 may cause the first lever assembly 30 to activate the detecting sensor 191 regardless of the amount of the printing media P loaded on the pressure plate 17 of the first printing media loading unit 10. A coil spring may be used as the first elastic member 47.

The second lever assembly 50 selectively rotates the first lever assembly 30 and is rotatably disposed in the second printing media loading unit 20. In other words, when at least one printing medium P is loaded on the second printing media loading unit 20, the second lever assembly 50 rotates the first lever assembly 30, and when there is no printing medium P on the second printing media loading unit 20, the second lever assembly 50 does not rotate the first lever assembly 30 and maintains a state in a position close to the second printing media loading unit 20.

Referring to FIGS. 8 and 9, the second lever assembly 50 is rotatably disposed in the second printing media loading unit 20 and may include a pressure lever 51, a second operating lever 60, a second elastic member 66, and a third elastic member 68.

The pressure lever 51 comes in contact with the first operating lever 40 of the first lever assembly 30 to selectively press the first operating lever 40. The pressure lever 51 includes a pressure lever shaft 52 that is rotatably disposed in the second printing media loading unit 20 and a pressure arm 53 extending away from the pressure lever shaft 52. The pressure arm 53 may extend in a vertical direction with respect to the pressure lever shaft 52.

The opposite ends of the pressure lever shaft 52 are rotatably supported by two shaft supporting members 20*a* disposed on the bottom surface of the second printing media loading unit 20. A protrusion 56 is formed on the pressure lever shaft 52.

The pressure arm 53 extends away from the pressure lever shaft 52 and has a length that is sufficient so that a front end 53*a* of the pressure arm 53 presses a top end 45*a* of the first operating arm 45 of the first lever assembly 30 and then the sensor lever 31 activates the detecting sensor 191. The pressure arm 53 may extend in a vertical direction with respect to the pressure lever shaft 52. According to the installation location of the first lever assembly 30 and second lever assembly 50, the pressure arm 53 may be properly bent to press the first operating arm 45 of the first lever assembly 30. A second hooking portion 54 and a third hooking portion 55, to which the second and third elastic members 66 and 68 are respectively hooked, are provided on opposite side surfaces of the pressure arm 53.

The second operating lever 60 is rotated by at least one printing medium P being loaded on the second printing media loading unit 20 and is rotatably disposed with respect to the pressure lever 51. In other words, the second operating lever 60 is disposed to be able to rotate a predetermined angle with respect to the pressure lever shaft 52 of the pressure lever 51. Accordingly, the second operating lever 60 may include a second shaft receiving portion 61 into which the pressure lever shaft 52 is inserted and a second operating arm 62 extending away from the second shaft receiving portion 61. The second operating arm 62 may extend in a vertical direction with respect to the second shaft receiving portion 61.

The second shaft receiving portion 61 is formed in a hollow cylindrical shape which the pressure lever shaft 52 can pass through and smoothly rotate inside. The second shaft receiving portion 61 includes an insert groove 63, that is deeply formed on the second shaft receiving portion 61 in the axial direction of the second shaft receiving portion 61, and a fixing groove 64 that is formed on a bottom end of the insert groove 63. The fixing groove 64 may extend in a direction perpendicular to the insert groove 63. Accordingly, after the protrusion 56 formed on the pressure lever shaft 52 is aligned to the insert groove 63, and the pressure lever shaft 52 starts to be inserted, the pressure lever shaft 52 is inserted into the second shaft receiving portion 61 until the protrusion 56 comes in contact with the bottom end of the insert groove 63. Then, after the pressure lever shaft 52 is rotated a predetermined angle, the protrusion 56 of the pressure lever shaft 52 is positioned in the fixing groove 64. As a result, the pressure lever 51 and the second operating lever 60 may not be separated from each other.

The second operating arm 62 extends away from an end of the second shaft receiving portion 61 and formed to project above the top surface of the second printing media loading unit 20. The second operating arm 62 may extend in a vertical direction with respect to an end of the second shaft receiving portion 61. In other words, the second operating arm 62 is formed so that a top portion of the second operating arm 62 projects above the top surface of the second printing media loading unit 20 through a second operating hole 21 of the second printing media loading unit 20. Also, the second operating arm 62 is formed so that when at least one printing medium P is loaded on the top surface of the second printing media loading unit 20, the top portion of the second operating arm 62 is pressed down by the printing medium P and then the top end of the second operating arm 62 maintains the same level as that of the top surface of the second printing media loading unit 20.

The second elastic member 66 is disposed between the pressure lever 51 and the second operating lever 60. In other words, the second elastic member 66 is inserted around the outer circumferential surface of the second shaft receiving portion 61. One end of the second elastic member 66 is hooked to a bottom end of the second operating arm 62 and the other end thereof is hooked to the second hooking portion 54 of the pressure arm 53. Accordingly, when the second operating lever 60 rotates, the pressure lever 51 is rotated along with the second operating lever 60. However, if a force larger than the elastic force of the second elastic member 66 is applied to the pressure lever 51, the second operating lever 60 can independently rotate a predetermined angle with respect to the pressure lever shaft 52. At this time, an angle by which the second operating lever 60 can rotate is determined by the size of the protrusion 56 formed on the pressure lever shaft 52, a width of the insert groove 63, and a width of the fixing groove 64 formed on the second shaft receiving portion 61 of the second operating lever 60.

The third elastic member 68 is inserted around an end portion of the pressure lever shaft 52 of the pressure lever 51 and allows the pressure lever 51 to maintain an original position in which the pressure lever 51 is in a position close to the bottom surface of the second printing media loading unit 20. One end of the third elastic member 68 is hooked to the third hooking portion 55 formed on the pressure arm 53, and the other end of the third elastic member 68 is hooked to the first hooking portion 20*b* formed on the bottom surface of the second printing media loading unit 20, so that the pressure lever 51 of the second lever assembly 50 is elastically supported by the third elastic member 68. Accordingly, when the printing medium P is not in contact with the second operating lever 60 of the second lever assembly 50, the third elastic member 68 works so that the pressure lever 51 is in a position close to the bottom surface of the second printing media loading unit 20, and the front end of the second operating lever 60 maintains to project above the top surface of the second printing media loading unit 20. When the printing medium P is loaded on the second printing media loading unit 20 and comes in contact with the second operating lever 60 of the second lever assembly 50, the second operating lever 60 is rotated a predetermined angle and then the front end of the second operating lever 60 is inserted into the second operating hole 21 so as to maintain the same level as that of the top surface of the second printing media loading unit 20.

The detecting sensor 191 is disposed to face the front surface of the printing media loading apparatus 1 inside the image forming apparatus 100. The detecting sensor 191 is electrically connected with a control portion 190 and sends sensing signals to the control portion 190. Any of various types of sensors capable of sensing action of the first lever assembly 30 may be used as the detecting sensor 191. In the present exemplary embodiment, a photo sensor is used as the detecting sensor 191. Accordingly, when the front end portion 33*a* of the sensor arm 33 of the first lever assembly 30 is positioned outside the sensing area of the photo sensor 191, light emitted from the light emitting portion 191*a* enters the light receiving portion 191*b* so that the photo sensor 191 is turned on. When the first lever assembly 30 is rotated and the front end portion 33*a* of the sensor arm 33 is positioned in the sensing area, light emitted from the light emitting portion 191 a is blocked by the front end portion 33*a* of the sensor arm 33 so as not to enter the light receiving portion 191*b*. As a result, the photo sensor 191 is turned off. When the photo sensor 191 is turned off, the control portion 190 perceives that the printing medium P is loaded on at least one of the first printing media loading unit 10 and the second printing media loading unit 20.

Hereinafter, operation of the printing media loading apparatus 1 for image forming apparatus according to an exemplary embodiment of the present inventive concept having the above-described structure will be explained.

Figure 10:
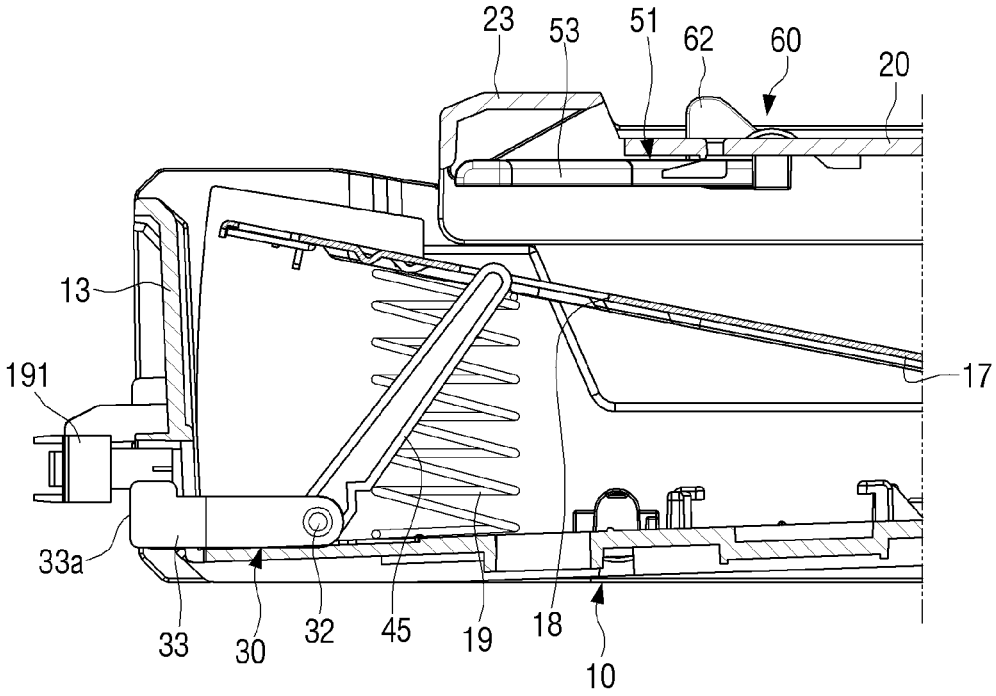
FIG. 10 is a partially sectional view illustrating when a printing medium is not loaded on a first and a second printing media loading units of a printing media loading apparatus according to an exemplary embodiment of the present inventive concept.

FIG. 10 illustrates a portion of the printing media loading apparatus 1, according to an exemplary embodiment of the present inventive concept, being mounted in the image forming apparatus 100. FIG. 10 illustrates a state in that the printing medium P is not loaded on the pressure plate 17 of the first printing media loading unit 10 and the second printing media loading unit 20.

At this time, a top end of the first operating lever 40 of the first lever assembly 30 projects above the pressure plate 17 and the front end portion 33*a* of the sensor arm 33 is positioned at the outside of sensing area of the detecting sensor 191. Also, the top end of the second operating lever 60 of the second lever assembly 50 projects above the second printing media loading unit 20 and the pressure arm 53 is near, or in contact with, the bottom surface of the second printing media loading unit 20. Accordingly, the pressure arm 53 of the second lever assembly 50 does not press down the first operating arm 45 of the first lever assembly 30. Therefore, the control portion 190 perceives that the detecting sensor 191 is turned on.

Figure 11:
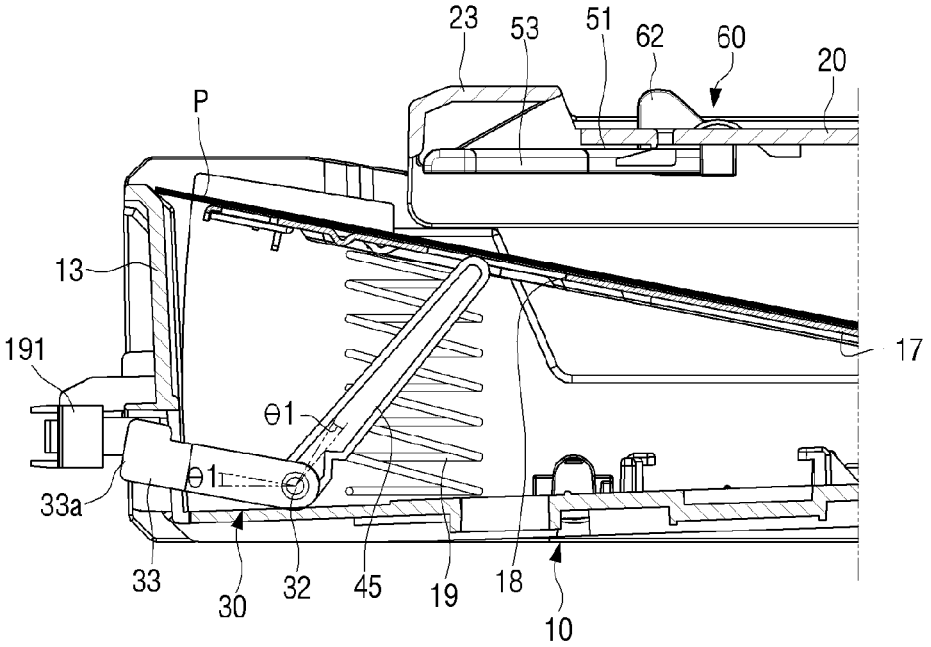
FIG. 11 is a partially sectional view illustrating when a sheet of printing medium is loaded on a first printing media loading unit of a printing media loading apparatus according to an exemplary embodiment of the present inventive concept.

FIG. 11 is a partially sectional view illustrating the printing media loading apparatus 1 being mounted in the image forming apparatus 100 after a sheet of printing medium P is loaded on the first printing media loading unit 10 of the printing media loading apparatus 1 by a user, and the second printing media loading unit 20 is free from any printing medium P being loaded thereon.

When a printing medium P is loaded on the pressure plate 17 of the first printing media loading unit 10, and the second printing media loading unit 20 is free from any printing medium P being loaded thereon, the top end of the first operating arm 45 of the first operating lever 40 is pressed down by the printing medium P and the first operating lever 40 is rotated a predetermined angle θ1 so that the top end of the first operating arm 45 is positioned at the same level as that of the top surface of the pressure plate 17. When the first operating lever 40 is rotated, the sensor lever 31 is rotated a predetermined angle along with the first operating lever 40 by the first elastic member 47. As a result, the sensor arm 33 is positioned in the sensing area of the detecting sensor 191 so that the light emitted from the light emitting portion 191*a* does not enter the light receiving portion 191*b*. Accordingly, the control portion 190 determines that the detecting sensor 191 is turned off, and so perceives that there is the printing medium P on the printing media loading apparatus 1. At this time, the second lever assembly 50 is maintained in the original position thereof without any operation since no printing medium is loaded on the second printing media loading unit 20.

In that state, after the pickup roller 110 picks up the printing medium P and feeds the printing medium P to the image forming unit 140, the first lever assembly 30 is rotated in the counterclockwise direction based on the sensor lever shaft 32 due to the weight portion 34 so that the front end portion 33*a* of the sensor arm 33 gets out of the sensing area of the detecting sensor 191. As a result, since the light emitted from the light emitting portion 191*a* of the detecting sensor 191 enters the light receiving portion 191*b*, the control portion 190 perceives the detecting sensor 191 to be turned on and determines that there is no printing medium P on the printing media loading apparatus 1.

Figure 12:
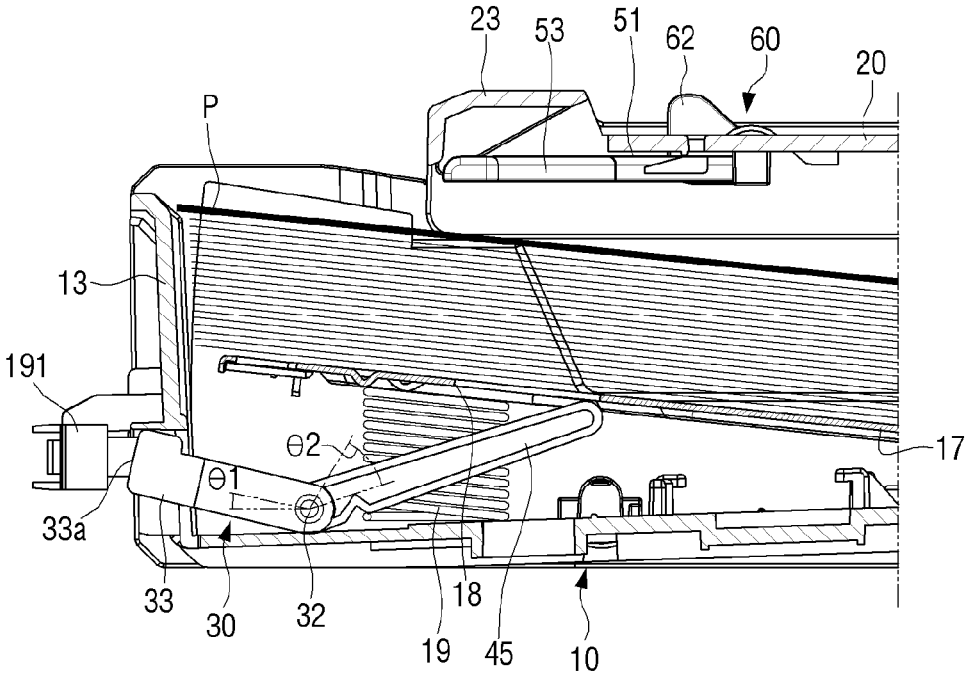
FIG. 12 is a partially sectional view illustrating when several sheets of printing media are loaded on a second printing media loading unit of a printing media loading apparatus according to an exemplary embodiment of the present inventive concept.

FIG. 12 is a partially sectional view illustrating the printing media loading apparatus 1 mounted in the image forming apparatus 100 after large amounts of printing media P are loaded on the first printing media loading unit 10 of the printing media loading apparatus 1 by a user.

Referring to FIG. 12, the first operating lever 40 of the first lever assembly 30 is rotated by an angle larger than the first operating lever 40 of the first lever assembly 30 as illustrated in FIG. 11 is rotated (θ2>θ1). In other words, the angle θ2 by which the first operating lever 40 is rotated is larger than the angle θ1 by which the sensor arm 33 is rotated based on the sensor lever shaft 32. As described above, when large amounts of printing media P are loaded on the pressure plate 17, the additional rotation angle of the first operating lever 40 is absorbed by the protrusion 35 of the sensor lever shaft 32 and the fixing groove 44 of the first shaft receiving portion 41. As a result, the first lever assembly 30 can activate the detecting sensor 191 regardless of number of printing media P loaded on the pressure plate 17 of the first printing media loading unit 10.

Figure 13:
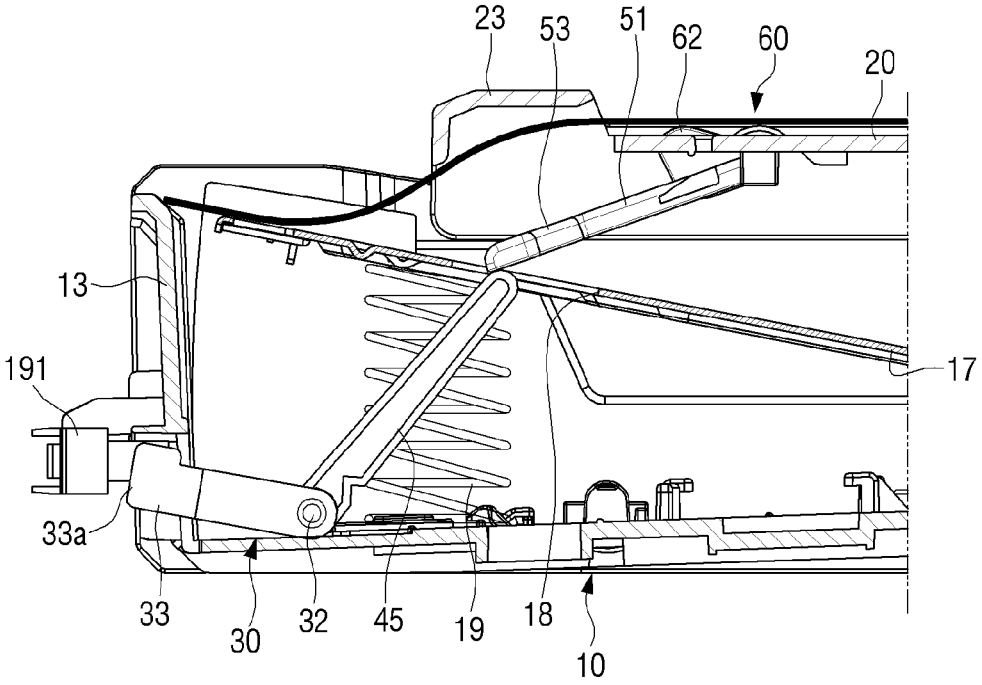
FIG. 13 is a partially sectional view illustrating when one sheet of printing medium is loaded on a second printing media loading unit in a state that there is no printing medium on a first printing media loading unit of a printing media loading apparatus according to an exemplary embodiment of the present inventive concept.

FIG. 13 is a partially sectional view illustrating an exemplary embodiment of the present inventive concept in which one sheet of printing medium P is loaded on the second printing media loading unit 20, of the image forming apparatus 100, and the first printing media loading unit 10 is free from any printing medium P being loaded thereon.

As illustrated in FIG. 13, when the printing medium P is loaded on the second printing media loading unit 20 in a state that no printing medium P is loaded on the first printing media loading unit 10, the top end of the second lever assembly 50 is pressed down by the printing medium P so that the second lever assembly 50 is rotated a predetermined angle in the counterclockwise direction. When the top end of the second lever assembly 50, that is, the top end of the second operating arm 62 of the second lever assembly 50, is pressed down by the printing medium P, the second operating arm 62 is rotated a predetermined angle based on the pressure lever shaft 52 in the counterclockwise direction. When the second operating arm 62 is rotated, the pressure lever 51 is rotated along with the second operating arm 62 in the counterclockwise direction by the second elastic member 66. When the pressure lever 51 of the second lever assembly 50 is rotated a predetermined angle in the counterclockwise direction, the front end 53*a* of the pressure arm 53 of the pressure lever 51 presses down the top end of the first operating lever 40 of the first lever assembly 30. When the top end of the first operating lever 40 of the first lever assembly 30 is pressed down, the first lever assembly 30 is rotated a predetermined angle so that the front end portion 33*a* of the sensor arm 33 is positioned in the sensing area of the detecting sensor 191. Operation of the first lever assembly 30 is the same as that of when the printing medium P presses down the first lever assembly 30 as described above. Therefore, a detail description thereof will be omitted.

After the printing medium P supplied from the second printing media loading unit 20 is picked up by the pickup roller 110 and is fed to the image forming unit 140, the second lever assembly 50 is rotated in the clockwise direction by the third elastic member 68 and then restored to the original position. Accordingly, as illustrated in FIG. 10, the top end of the second operating arm 62 of the second lever assembly 50 projects above the second operating hole 21 of the second printing media loading unit 20. When the second lever assembly 50 is restored to the original position thereof, the pressure lever 51 pressing the first operating arm 45 of the first lever assembly 30 is removed so that the first lever assembly 30 is rotated in the counterclockwise direction by the weight of the weight portion 34. Then, since the front end portion 33*a* of the sensor arm 33 of the first lever assembly 30 gets out of the sensing area of the detecting sensor 191, the control portion 190 determines that the detecting sensor 191 is turned on and perceives that there is no printing medium P on the printing media loading apparatus 1.

Figure 14:
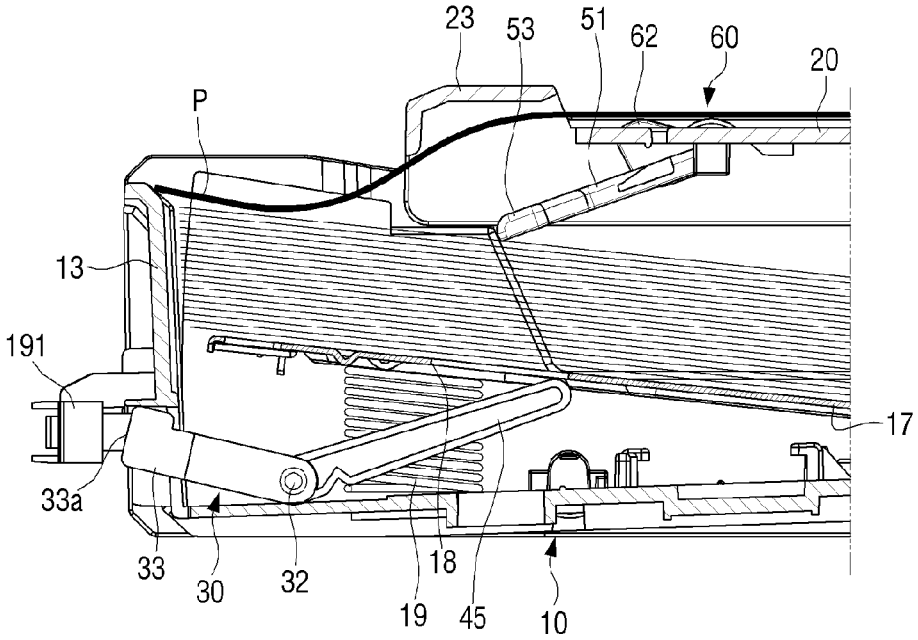
FIG. 14 is a partially sectional view illustrating when one sheet of printing medium is loaded on a second printing media loading unit in a state that several sheets of printing media are loaded on a first printing media loading unit of a printing media loading apparatus according to an exemplary embodiment of the present inventive concept.

FIG. 14 is a partially sectional view illustrating an exemplary embodiment of the present inventive concept in which one sheet of printing medium P is loaded on the second printing media loading unit 20, and large amounts of printing media P are loaded on the first printing media loading unit 10 of the image forming apparatus 100, as illustrated in FIG. 12.

In FIG. 14, since the printing medium P is loaded on the first printing media loading unit 10, the sensor arm 33 of the first lever assembly 30 activates the detecting sensor 191 so that the detecting sensor 191 is turned off. Therefore, the control portion 190 determines that printing media P is loaded on the printing media loading apparatus 1.

In this state, when the printing medium P is loaded on the second printing media loading unit 20, the top end of the second operating lever 60 of the second lever assembly 50 is pressed by the printing medium P. Then, the second operating lever 60 is rotated a predetermined angle, and then the top end of the second operating arm 62 is inserted into the second operating hole 21 so as to be positioned at the same level as that of the top surface of the second printing media loading unit 20. At this time, since rotation of the pressure lever 51 is limited by the printing media P loaded on the first printing media loading unit 10, rotation angle of the pressure lever 51 is less than that of the second operating lever 60. However, since the second operating lever 60 can be rotated with respect to the pressure lever shaft 52, the second operating lever 60 is rotated with respect to the pressure lever shaft 52 so as to absorb the angle that the pressure lever 51 is not rotated. The angle that the pressure lever 51 and the second operating lever 60 can rotate relative to each other is determined by the protrusion 56 formed on the pressure lever shaft 52, the width of the insert groove 63, and the width of the fixing groove 64 formed on the second shaft receiving portion 61 of the second operating lever 60.

Accordingly, if the printing medium P is loaded on the first printing media loading unit 10, although the printing medium P is loaded on the second printing media loading unit 20, the second lever assembly 50 does not rotate the first lever assembly 30.

In this state, if the printing medium P loaded on the top surface of the second printing media loading unit 20 is removed, the second lever assembly 50 is restored to the original position thereof by the third elastic member 68. The state in which the second lever assembly 50 is restored to the original position by the third elastic member 68 is described above. Therefore, a detailed description thereof will be omitted.

The image forming unit 140 forms an image corresponding to the received printing data according to a command of the control portion 190. In the present exemplary embodiment, the image forming unit 140 includes a photosensitive medium 141 and a developing roller 143. Accordingly, the control portion 190 controls an exposure unit 130 to form a certain electrostatic latent image on the surface of the photosensitive medium 141 according to the printing data. After that, the control portion 190 uses the developing roller 143 to supply developer to the photosensitive medium 141, thereby developing the electrostatic latent image formed on the photosensitive medium 141 into a developer image.

The transfer roller 150 is rotatably disposed to face the photosensitive medium 141 of the image forming unit 140 and allows the developer image formed on the photosensitive medium 141 to be transferred onto the printing medium P supplied from the printing media loading apparatus 1.

The fusing unit 160 is disposed downstream of the image forming unit 140 and includes a heating roller 161 and a pressing roller 163 that can apply heat and pressure to the printing medium P. When the printing medium P, on which the developer image is transferred, passes between the heating roller 161 and the pressing roller 163, of the fusing unit 160, the developer image is fused on the printing medium P.

The printing media discharging unit 170 discharges the printing medium P, on which the image is fused, while passing through the fusing unit 160 to the outside of the image forming apparatus 100.

The control portion 190 is disposed inside the case 101 of the image forming apparatus 100 and determines whether any printing medium P is loaded on the printing media loading apparatus 1. If there is printing medium P loaded on the printing media loading apparatus 1, the control portion 190 controls the pickup roller 110, the image forming unit 140, the transfer roller 150, the fusing unit 160, the printing media discharging unit 170, and the like to perform a printing work.

The control portion 190 receives a signal from the detecting sensor 191 to determine whether any printing medium P is loaded on the printing media loading apparatus 1.

When there is no printing medium P on the printing media loading apparatus 1, that is, both the first printing media loading unit 10 and the second printing media loading unit 20 are free from any printing medium P being loaded thereon, the detecting sensor 191 is turned on. When an on signal comes from the detecting sensor 191, the control portion 190 determines that there is no printing medium P loaded on the printing media loading apparatus 1.

When printing medium P is loaded on the first printing media loading unit 10, and the second printing media loading unit 20 is free from any printing medium P being loaded thereon, the sensor arm 33 of the first lever assembly 30 turns the detecting sensor 191 off. When receiving an off signal from the detecting sensor 191, the control portion 190 determines that there is printing medium P loaded on the printing media loading apparatus 1.

When printing medium P is loaded on the second printing media loading unit 20, and no printing medium P is loaded on the first printing media loading unit 10, the second lever assembly 50 is rotated to rotate the first lever assembly 30 so that the sensor arm 33 of the first lever assembly 30 turns the detecting sensor 191 off. Accordingly, the control portion 190 determines that there is the printing medium P on the printing media loading apparatus 1.

When the printing medium P is loaded on the second printing media loading unit 20 and at least one printing medium P is loaded on the first printing media loading unit 10, the printing media P loaded on the first printing media loading unit 10 rotates the first lever assembly 30 to turn the detecting sensor 191 off. Accordingly, the control portion 190 determines that there is printing medium P loaded on the printing media loading apparatus 1.

In the above description, when the detecting sensor 191 is turned from on to off, the control portion 190 is set to determine that there is printing medium P loaded on the printing media loading apparatus 1. However, the control portion 190 may be set to the opposite. In other words, the detecting sensor 191 may be set so that when there is printing medium P loaded on the printing media loading apparatus 1, the detecting sensor 191 may be turned on and when there is no printing medium P on the printing media loading apparatus 1, the detecting sensor 191 may be turned off.

With a printing media loading apparatus usable with an image forming apparatus according to an exemplary embodiment of the present inventive concept, as described above, a control portion can know whether at least one printing medium P is loaded on a first printing media loading unit and a second printing media loading unit by using only one detecting sensor. Therefore, material cost of the image forming apparatus can be reduced.

Also, since a printing media loading apparatus usable with an image forming apparatus according to an exemplary embodiment of the present inventive concept uses only one detecting sensor, a software algorithm for controlling the image forming apparatus may be simplified so that a likelihood of bugs may be reduced.

Further, since the printing media loading apparatus uses only one detecting sensor, it is advantageous to miniaturize the image forming apparatus.

While the embodiments of the present general inventive concept have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the inventive concepts.

What is claimed is:

1. A printing media loading apparatus usable with an image forming apparatus comprising:

a first printing media loading unit detachably disposed in the image forming apparatus;

a second printing media loading unit disposed above the first printing media loading unit when the first printing media loading unit is mounted in the image forming apparatus;

a first lever assembly rotatably disposed in the first printing media loading unit;

a second lever assembly disposed in the second printing media loading unit to selectively rotate the first lever assembly; and a detecting sensor disposed in the image forming apparatus to detect action of the first lever assembly, wherein, when at least one printing medium is loaded on the second printing media loading unit in a state that there is no printing medium loaded on the first printing media loading unit, the second lever assembly is rotated and the first lever assembly is rotated by rotation of the second lever assembly to activate the detecting sensor.

2. The printing media loading apparatus of claim 1, wherein:

when at least one printing medium is loaded on the first printing media loading unit, the first lever assembly is operated to activate the detecting sensor; and when the at least one printing medium is loaded on the second printing media loading unit in a state that the at least one printing medium is loaded on the first printing media loading unit, the second lever assembly does not rotate the first lever assembly.

3. The printing media loading apparatus of claim 1, wherein the first lever assembly comprises:

a sensor lever rotatably disposed in the first printing media loading unit and activates the detecting sensor;

a first operating lever disposed to be able to rotate with respect to the sensor lever and rotated by any one of the second lever assembly or the printing medium loaded on the first printing media loading unit; and a first elastic member disposed between the sensor lever and the first operating lever.

4. The printing media loading apparatus of claim 3, wherein the sensor lever comprises:

a sensor lever shaft rotatably disposed in the first printing media loading unit;

a sensor arm extending away from the sensor lever shaft; and a weight portion disposed on a side surface of the sensor arm, wherein the first operating lever comprises:

a shaft receiving portion in which the sensor lever shaft is inserted; and a first operating arm extended vertically from the shaft receiving portion.

5. The printing media loading apparatus of claim 4, wherein the sensor lever further comprises:

a protrusion formed on the sensor lever shaft; and the first operating lever further comprises:

an insert groove formed on the shaft receiving portion in an axial direction of the shaft receiving portion, the insert groove formed to receive the protrusion; and a fixing groove formed on the shaft receiving portion in a direction perpendicular to the insert groove, the fixing groove being arranged to fix the protrusion.

6. The printing media loading apparatus of claim 5, wherein:

when the protrusion is positioned in the fixing groove, the first operating lever and the sensor lever are not separated from each other.

7. The printing media loading apparatus of claim 3, wherein the second lever assembly comprises:

a pressure lever that is rotatably disposed in the second printing media loading unit and selectively presses the first operating lever of the first lever assembly;

a second operating lever disposed to be able to rotate with respect to the pressure lever and rotated by the printing medium loaded on the second printing media loading unit;

a second elastic member disposed between the pressure lever and the second operating lever; and a third elastic member elastically supporting the pressure lever to be close to the second printing media loading unit.

8. The printing media loading apparatus of claim 7, wherein the pressure lever comprises:

a pressure lever shaft rotatably disposed in the second printing media loading unit; and a pressure arm extending away from the pressure lever shaft, and the second operating lever comprises:

a shaft receiving portion in which the pressure lever shaft is inserted; and a second operating arm extended vertically from the shaft receiving portion.

9. The printing media loading apparatus of claim 8, wherein the pressure lever further comprises:

at least one protrusion formed on the pressure lever shaft, and the second operating lever further comprises:

an insert groove formed on the shaft receiving portion in an axial direction of the shaft receiving portion, the insert groove formed to receive the protrusion; and a fixing groove formed on the shaft receiving portion in a direction perpendicular to the insert groove, the fixing groove being arranged to fix the protrusion.

10. The printing media loading apparatus of claim 9, wherein:

when the protrusion is positioned in the fixing groove, the second operating lever is not separated from the pressure lever.

11. The printing media loading apparatus of claim 9, wherein:

the second printing media loading unit is disposed above and formed integrally with the first printing media loading unit.

12. The printing media loading apparatus of claim 11, wherein:

the first printing media loading unit comprises a printing medium feeding cassette; and the second printing media loading unit comprises a multipurpose tray disposed above the printing medium feeding cassette.

13. The printing media loading apparatus of claim 12, wherein:

the printing medium feeding cassette comprises a pressure plate;

the first lever assembly is disposed below the pressure plate and on a bottom surface of the printing medium feeding cassette; and the second lever assembly is disposed on a bottom surface of the second printing media loading unit.

14. The printing media loading apparatus of claim 13, wherein the printing medium feeding cassette further comprises:

a sensing hole that is formed on a front surface of the printing medium feeding cassette and limits rotation of the sensor lever, the sensing hole through which the sensor lever of the first lever assembly projects; and a first operating hole formed on the pressure plate, the first operating hole through which a portion of the first operating lever of the first lever assembly projects above the pressure plate.

15. The printing media loading apparatus of claim 14, wherein the second printing media loading unit further comprises:

a second operating hole through which a portion of the second operating lever of the second lever assembly projects.

16. An image forming apparatus comprising:

a printing media loading apparatus supplying a printing medium;

an image forming unit to form an image on the printing medium supplied from the printing media loading apparatus; and a control portion configured to control the printing media loading apparatus and the image forming unit to perform a printing, wherein the printing media loading apparatus comprises:

a first printing media loading unit detachably disposed in the image forming apparatus;

a second printing media loading unit disposed above the first printing media loading unit when the first printing media loading unit is mounted in the image forming apparatus;

a first lever assembly rotatably disposed in the first printing media loading unit;

a second lever assembly disposed in the second printing media loading unit to selectively rotate the first lever assembly; and a detecting sensor disposed in the image forming apparatus to detect action of the first lever assembly, wherein, when at least one printing medium is loaded on the second printing media loading unit in a state that there is no printing medium loaded on the first printing media loading unit, the second lever assembly is rotated and the first lever assembly is rotated by rotation of the second lever assembly to activate the detecting sensor.

17. The image forming apparatus of claim 16, wherein:

when the printing medium is loaded on at least one of the first printing media loading unit and the second printing media loading unit, the control portion determines that the printing medium is loaded.

18. An image forming apparatus comprising:

a first printing media loading unit;

a first lever arranged to move according to a presence of a first printing medium on the first printing media loading unit;

a second printing media loading unit;

a second lever arranged to move according to a presence of a second printing medium on the second printing media loading unit and the first printing media loading unit being free from presence of the first printing medium thereon, and, upon movement, the second lever causing movement of the first lever; and a single detecting sensor to detect the movement of the first lever.

19. The image forming apparatus according to claim 18, wherein the image forming apparatus is free from a second detecting sensor to detect a movement of the second lever when at least one second printing medium is present on the second printing media loading unit regardless of whether the first printing medium is present on the first printing media loading unit.

20. The image forming apparatus according to claim 18, wherein the first lever further comprises:

a first operating lever; and a sensor lever, the first operating lever being coupled with the sensor lever and, when at least one first printing medium is loaded on the first printing media loading unit, the first lever being moved by the first printing medium which causes movement of the first operating lever and the sensor lever to activate the single detecting sensor.

21. The image forming apparatus according to claim 20, wherein the first operating lever and the sensor lever are formed of a synthetic resin containing glass.

* * * * *